US010818423B2

(12) United States Patent
Yoshida et al.

(10) Patent No.: US 10,818,423 B2
(45) Date of Patent: Oct. 27, 2020

(54) REACTOR HAVING COVERING PORTIONS HAVING FITTING PARTS FITTED TO EACH OTHER

(71) Applicant: FANUC CORPORATION, Minamitsuru-gun, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 0 days.

(21) Appl. No.: 16/018,776

(22) Filed: Jun. 26, 2018

(65) Prior Publication Data

US 2019/0013134 A1 Jan. 10, 2019

(30) Foreign Application Priority Data

Jul. 7, 2017 (JP) ..... 2017-133886

(51) Int. Cl.

| | |
|---|---|
| ***H01F 27/26*** | (2006.01) |
| ***H01F 27/28*** | (2006.01) |
| ***H01F 3/14*** | (2006.01) |
| ***H01F 27/32*** | (2006.01) |
| ***H01F 37/00*** | (2006.01) |

(52) U.S. Cl.

CPC ..... *H01F 27/26* (2013.01); *H01F 3/14* (2013.01); *H01F 27/28* (2013.01); *H01F 27/32* (2013.01); *H01F 37/00* (2013.01)

(58) Field of Classification Search

CPC ..... H01F 27/26; H01F 27/28

USPC ..... 336/5, 170, 200, 232

See application file for complete search history.

(56) References Cited

U.S. PATENT DOCUMENTS

| | | | | |
|---|---|---|---|---|
| 2,406,704 | A * | 8/1946 | Mossay | H01F 30/12 336/5 |
| 5,227,745 | A * | 7/1993 | Oda | H01F 27/263 333/167 |
| 9,646,760 | B2 | 5/2017 | Imanishi et al. | |
| 2004/0246089 | A1* | 12/2004 | Stephens | H02M 3/33569 336/212 |
| 2006/0279392 | A1* | 12/2006 | Shinmen | H01F 3/10 336/180 |
| 2009/0261939 | A1 | 10/2009 | Shudarek | |
| 2012/0106210 | A1 | 5/2012 | Xu et al. | |
| 2012/0242444 | A1* | 9/2012 | Tseng | H01F 27/2823 336/170 |

(Continued)

FOREIGN PATENT DOCUMENTS

| | | | |
|---|---|---|---|
| CN | 201765902 | U | 3/2011 |
| CN | 105742038 | A | 7/2016 |

(Continued)

*Primary Examiner* — Tszfung J Chan

(74) *Attorney, Agent, or Firm* — RatnerPrestia

(57) ABSTRACT

A reactor according to an embodiment of the present disclosure includes a core body. The core body includes a peripheral iron core composed of a plurality of peripheral iron core portions, at least three iron cores coupled to the peripheral iron core portions, and coils wound on the iron cores. Gaps are formed between one of the iron cores and another iron core adjacent thereto, so as to be magnetically connectable through the gaps. The reactor further includes a plurality of covering portions each for covering each of the coils. The covering portions adjacent in a circumferential direction can be fitted to each other.

9 Claims, 6 Drawing Sheets

(56) References Cited

U.S. PATENT DOCUMENTS

| | | | | |
|---|---|---|---|---|
| 2015/0102882 | A1 | 4/2015 | Shudarek | |
| 2016/0125998 | A1 | 5/2016 | Bhide et al. | |
| 2017/0040099 | A1* | 2/2017 | Bhide | H01F 27/245 |
| 2017/0084377 | A1 | 3/2017 | Maeda et al. | |
| 2018/0234008 | A1* | 8/2018 | Wolf | H01F 37/00 |
| 2018/0268992 | A1 | 9/2018 | Tsukada et al. | |
| 2019/0013134 | A1 | 1/2019 | Yoshida et al. | |

FOREIGN PATENT DOCUMENTS

| | | | | | |
|---|---|---|---|---|---|
| CN | 208460540 | U | | 2/2019 | |
| DE | 2326294 | A1 | | 12/1973 | |
| DE | 102016010901 | A1 | | 3/2017 | |
| DE | 102018105659 | A1 | | 9/2018 | |
| EP | 3038117 | B1 | | 9/2017 | |
| GB | 1415209 | A | * | 11/1975 | H01F 27/02 |
| GB | 1415209 | A | | 11/1975 | |
| JP | 49043123 | A | | 4/1974 | |
| JP | 02152210 | A | * | 6/1990 | |
| JP | H02152210 | A | | 6/1990 | |
| JP | 2000-77242 | A | | 3/2000 | |
| JP | 2008-210998 | A | | 9/2008 | |
| JP | 2008-210998 | A | | 11/2008 | |
| JP | 2016127121 | A | | 7/2016 | |
| JP | 2017059805 | A | | 3/2017 | |

* cited by examiner

REACTOR HAVING COVERING PORTIONS HAVING FITTING PARTS FITTED TO EACH OTHER

This application is a new U.S. patent application that claims benefit of JP 2017-133886 filed on Jul. 7, 2017, the content of 2017-133886 is incorporated herein by reference.

BACKGROUND OF THE INVENTION

1. Field of the Invention

The present invention relates to a reactor, and more specifically, relates to a reactor having covering portions having fitting parts that are fitted to each other.

2. Description of Related Art

Reactors each include a plurality of iron core coils, and each iron core coil includes an iron core and a coil wound on the iron core. Predetermined gaps are formed between the iron cores. For example, refer to Japanese Unexamined Patent Publication (Kokai) Nos. 2000-77242 and 2008-210998.

There are also reactors in which a plurality of iron cores and coils wound on the iron cores are disposed inside a peripheral iron core constituted of a plurality of peripheral iron core portions. In the reactor, each iron core is integrated into each peripheral iron core portion. At the center of the reactor, predetermined gaps are formed between the iron cores adjacent to each other.

SUMMARY OF THE INVENTION

In such a reactor, the coils are attached to the iron cores in a state of being contained in casings (hereinafter also referred to as "covering portions"). Thus, in the production of the reactor, when assembling the iron cores to which the coils contained in the casings are attached, assembly position deviates. The assembly position deviation causes an increase in manufacturing man-hour, or an increase in difficulty in automation of the manufacturing process.

Therefore, a reactor that does not require an increase in manufacturing man-hour, and an increase in difficulty in automation of the manufacturing process is desired.

A reactor according to an embodiment of the present disclosure includes a core body. The core body includes a peripheral iron core composed of a plurality of peripheral iron core portions, at least three iron cores coupled to the peripheral iron core portions, and coils wound on the iron cores. Gaps are formed between one of the iron cores and another of the iron cores adjacent to the one of the iron cores, so as to be magnetically connectable through the gap. The reactor includes a plurality of covering portions each for covering each of the coils. The covering portions adjacent in a circumferential direction can be fitted to each other.

BRIEF DESCRIPTION OF THE DRAWINGS

The objects, features, and advantages of the present invention will be more apparent from the following description of an embodiment relating to the accompanying drawings. In the drawings.

DETAILED DESCRIPTION OF THE INVENTION

Figure 1:
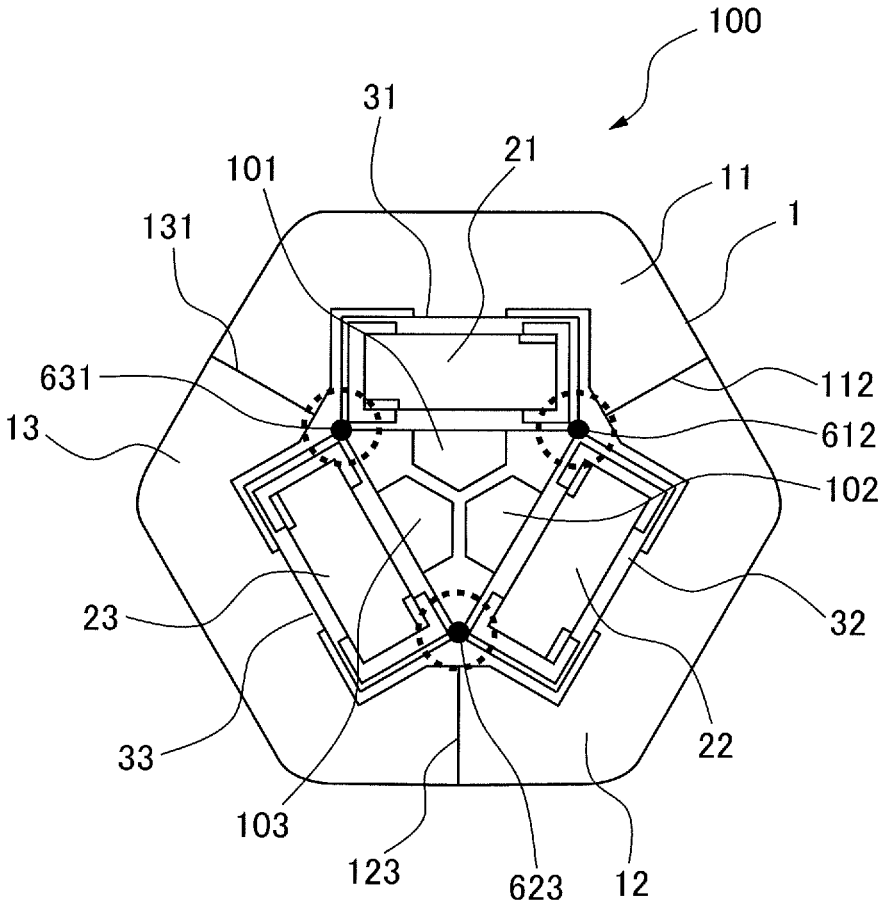
FIG. 1 is a plan view of a part of a reactor according to an embodiment.

An embodiment of the present invention will be described below with reference to the accompanying drawings. In the drawings, the same components are indicated with the same reference numerals. For ease of understanding, the scales of the drawings have been modified in an appropriate manner.

The following description mainly describes a three-phase reactor as an example. However, the present disclosure can be widely applied to not only the three-phase reactor but also any multiphase reactor that requires a constant inductance in each phase. The reactor according to the present disclosure can be applied to various types of equipment, as well as being applied to the primary or secondary side of an inverter in an industrial robot or a machine tool.

Figure 2A:
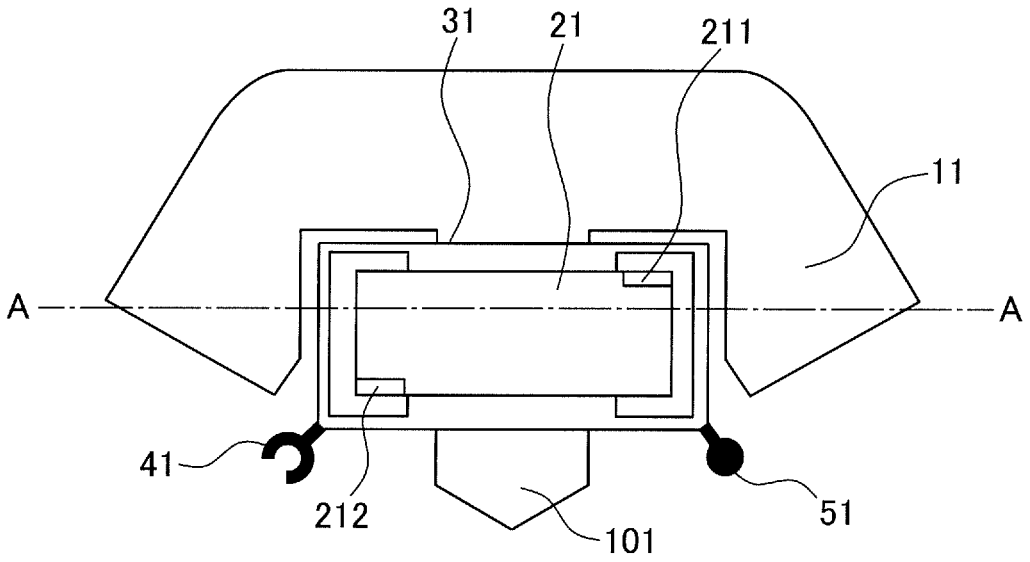
FIG. 2A is a plan view of a part of the reactor according to the embodiment.
Figure 2B:
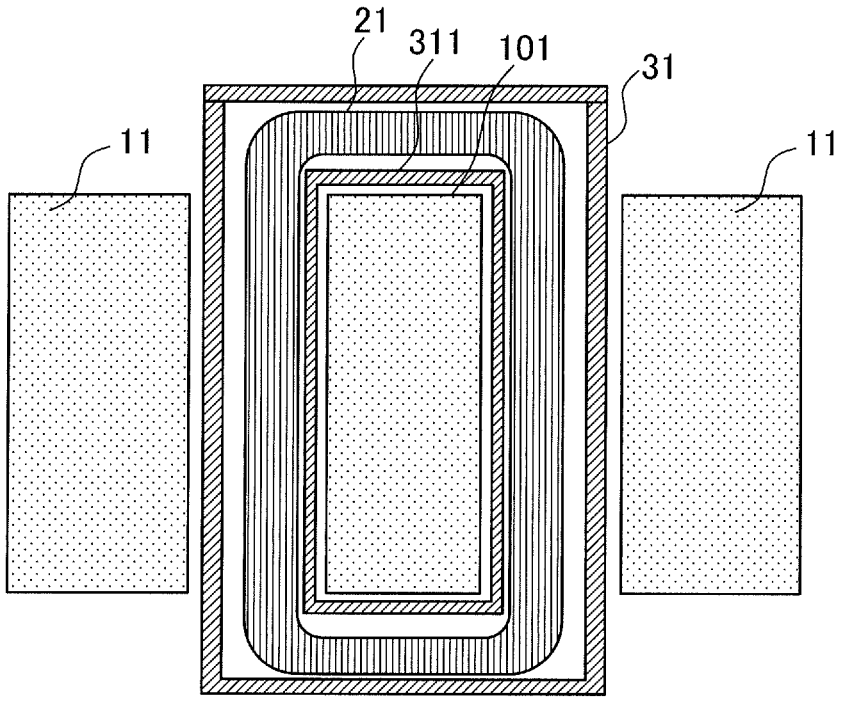
FIG. 2B is a sectional view of a part of the reactor according to the embodiment.

FIG. 1 is a plan view of a reactor according to an embodiment. FIG. 2A is a plan view of a part of the reactor according to the embodiment. FIG. 2B is a sectional view of a part of the reactor according to the embodiment, taken on line A-A of FIG. 2A.

The reactor according to the embodiment includes a core body 100 that includes a peripheral iron core 1 constituted of a plurality of peripheral iron core portions (11, 12, and 13), at least three iron cores (101, 102, and 103), coils (21, 22, and 23), and covering portions (31, 32, and 33). In FIG. 1, by way of example, the reactor is a three-phase reactor, and the three peripheral iron core portions (11, 12, and 13), the three coils (21, 22, and 23), and the three covering portions (31, 32, and 33) are arranged in positions rotated by 120°, but the present invention is not limited to this example. However, the number of the iron cores is preferably an integral multiple of three. In the case of the three-phase reactor, the coil 21 may be an R-phase coil, the coil 22 may be an S-phase coil, and the coil 23 may be a T-phase coil. The number of the iron cores may be an even number of four or more.

The iron cores (101, 102, and 103) are provided in the peripheral iron core portions (11, 12, and 13), respectively, inside the peripheral iron core 1 in a radial direction. The iron cores (101, 102, and 103) are coupled to the peripheral iron core portions (11, 12, and 13). The peripheral iron core portions (11, 12, and 13) are divided by three dividing surfaces (112, 123, and 131). The peripheral iron core portions (11, 12, and 13) can be formed by laminating a plurality of electromagnetic steel sheets. Alternatively, the peripheral iron core portions (11, 12, and 13) may be made of pressed powder compacts. Gaps are formed between one of the iron cores (101, 102, and 103) and another iron core adjacent thereto, so as to be magnetically connectable through the gap.

The coils (21, 22, and 23) are wound on the iron cores (101, 102, and 103), respectively.

In each of the coils (21, 22, and 23), a conductor is wound helically. As the conductor, a rectangular wire, a round wire, etc., made of a conductive material containing copper, aluminum, magnesium, etc., can be used. As shown in FIG. 2A, an end portion of the coil 21 can be connected to an external device as an input terminal 211 or an output terminal 212. As shown in FIG. 2B, an approximately rectangular space is formed inside the coil 21, and a part of the iron core 101 is disposed in the space.

The covering portion 31 contains the coil 21. The covering portion 31 has an opening inside of which a part of the iron core 101 is disposed. As shown in FIG. 2B, the covering portion 31 is preferably structured so as to cover the periphery of the coil 21. However, the covering portion 31 may have the shape of a box having an opened top.

The covering portions (31, 32, and 33) cover the coils (21, 22, and 23), respectively. The covering portions (31, 32, and 33) are preferably made of an insulating material. As a result, the covering portions (31, 32, and 33) can insulate between the coils (21, 22, and 23) and the peripheral iron core portions (11, 12, and 13). The covering portions (31, 32, and 33) may be made of a resin material. As the resin material, a thermoplastic resin, a thermosetting resin, etc., can be used.

As shown in FIG. 2B, an insulating member 311 may be provided on the covering portion 31. The insulating member 311 is preferably disposed between an inner peripheral surface of the coil 21 and the iron core 101. The insulating member 311 is preferably integrated into the covering portion 31. The covering portion 31 may be made of a sheet-like insulating material.

In example shown in FIG. 2A, the covering portion 31 includes a first fitting part 41 and a second fitting part 51. As described later, the first fitting part 41 is fitted onto a second fitting part of another covering portion adjacent thereto. The second fitting part 51 is fitted into a first fitting part of another covering portion adjacent thereto.

Figure 3:
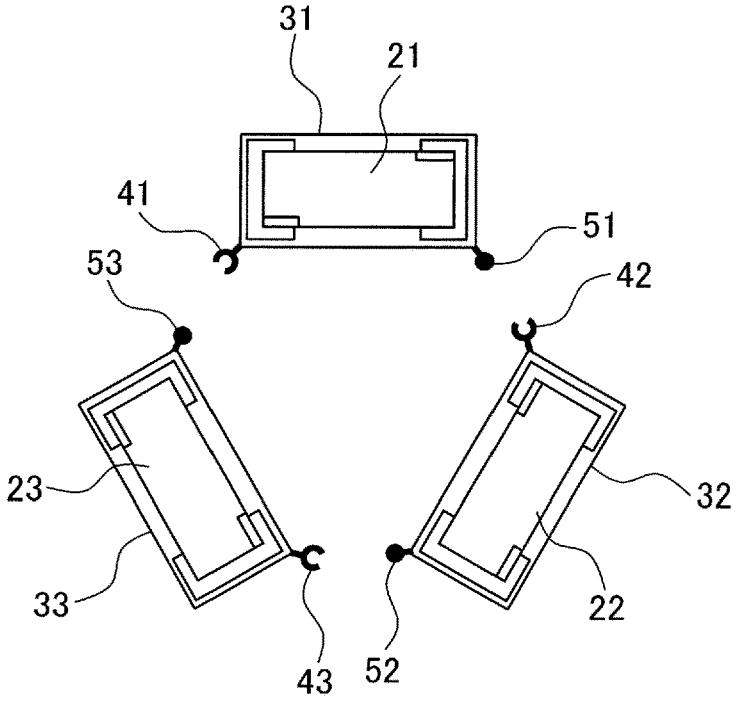
FIG. 3 is a plan view of covering portions, before coupling, constituting the reactor according to the embodiment.

FIG. 3 is a plan view of the covering portions, before coupling, constituting the reactor according to the embodiment. The covering portions (31, 32, and 33) are characterized in that the covering portions adjacent to each other in the circumferential direction can be fitted to each other. First fitting parts (41, 42, and 43) and second fitting parts (51, 52, and 53) are preferably provided at the corners of the covering portions (31, 32, and 33) that are close together when the covering portions (31, 32, and 33) are annularly arranged.

In FIG. 1, the covering portions 31 and 32 are fitted at a fitting portion 612. The covering portions 32 and 33 are fitted at a fitting portion 623. The covering portions 33 and 31 are fitted at a fitting portion 631. In the fitting portion 612 shown in FIG. 1, as shown in FIG. 3, the second fitting part 51 of the covering portion 31 may be fitted into the first fitting part 42 of the covering portion 32. Alternatively, in the fitting portion 612, a first fitting part of the covering portion 31 may be fitted onto a second fitting part of the covering portion 32.

In the same manner, in the fitting portion 623 shown in FIG. 1, as shown in FIG. 3, the second fitting part 52 of the covering portion 32 may be fitted into the first fitting part 43 of the covering portion 33. Alternatively, in the fitting portion 623, a first fitting part of the covering portion 32 may be fitted onto a second fitting part of the covering portion 33.

In the same manner, in the fitting portion 631 shown in FIG. 1, as shown in FIG. 3, the second fitting part 53 of the covering portion 33 may be fitted into the first fitting part 41 of the covering portion 31. Alternatively, in the fitting portion 631, a first fitting part of the covering portion 33 may be fitted onto a second fitting part of the covering portion 31.

Figure 4:
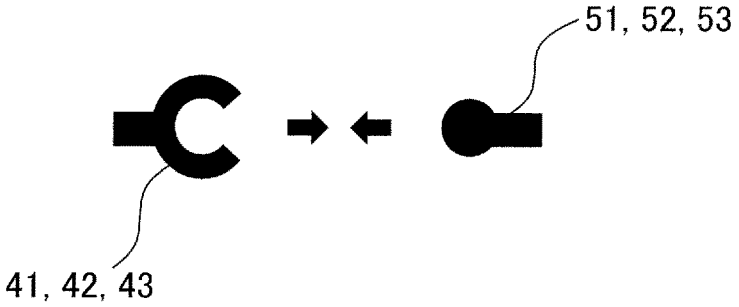
FIG. 4 is a plan view of a fitting portion constituting the reactor according to the embodiment.

FIG. 4 is a plan view of a fitting portion constituting the reactor according to the embodiment. The first fitting part (41, 42, or 43) and the second fitting part (51, 52, or 53), which constitute the fitting portion (612, 623, or 631), preferably have a fitting structure. The first fitting parts (41, 42, and 43) and the second fitting parts (51, 52, and 53) are preferably elastically deformable, and are preferably made of, for example, a metal, a synthetic resin, etc. By forming the first fitting parts (41, 42, and 43) and the second fitting parts (51, 52, and 53) from an elastically deformable material, the first fitting parts (41, 42, and 43) and the second fitting parts (51, 52, and 53) become detachable from each other.

Figure 5:
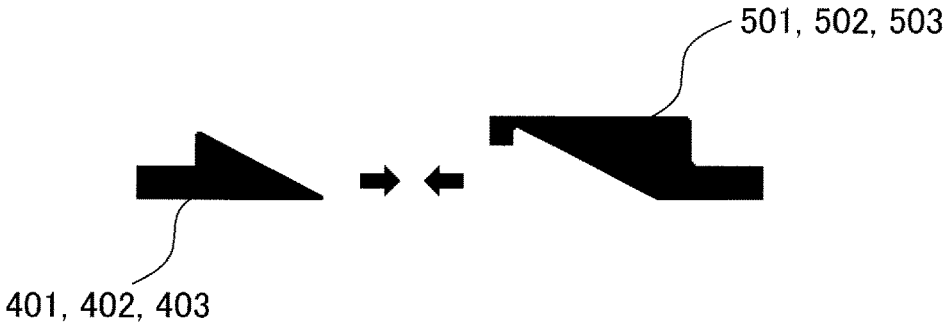
FIG. 5 is a plan view of a fitting portion constituting a reactor according to a modification example of the embodiment.

FIG. 5 is a plan view of a fitting portion constituting a reactor according to a modification example of the embodiment. A first fitting part (401, 402, or 403) and a second fitting part (501, 502, or 503), which constitute the fitting portion (612, 623, or 631), preferably have an engaging structure. The first fitting parts (401, 402, and 403) and the second fitting parts (501, 502, and 503) are preferably elastically deformable, and are preferably made of, for example, a metal, a synthetic resin, etc. By forming the first fitting parts (401, 402, and 403) and the second fitting parts (501, 502, and 503) from an elastically deformable material, the first fitting parts (401, 402, and 403) and the second fitting parts (501, 502, and 503) become detachable from each other.

FIGS. 4 and 5 show examples in which the first fitting part and the second fitting part have different structures, but a first fitting part and a second fitting part may have the same structure fitted to each other.

As shown in FIG. 3, reference numerals 41, 42, and 43 indicate the first fitting parts provided in the covering portions 31, 32, and 33, respectively. Reference numerals 51, 52, and 53 indicate the second fitting parts provided in the covering portions 31, 32, and 33, respectively. However, this is merely an example, and the covering portion 31 may have two first fitting parts, or two second fitting parts. For example, when the covering portion 31 has two first fitting parts, it is necessary that the covering portion 32 have a second fitting part in the fitting portion 612, and it is necessary that the covering portion 33 have a second fitting part in the fitting portion 631.

Figure 6:
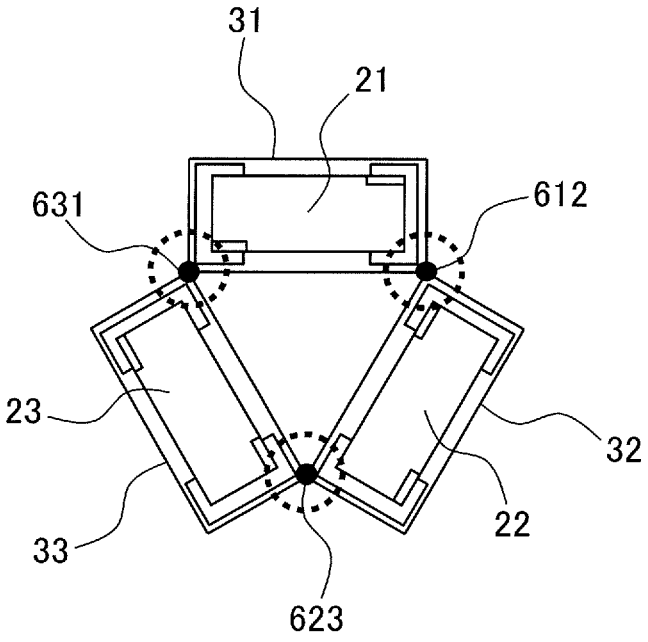
FIG. 6 is a plan view of the covering portions, after coupling, constituting the reactor according to the embodiment.

FIG. 6 is a plan view of the covering portions, after coupling, constituting the reactor according to the embodiment. When the covering portions (31, 32, and 33) are annularly arranged, each of the covering portions (31, 32, and 33) is coupled to the other covering portions adjacent thereto, at the fitting portions (612, 623, and 631).

Figure 7:
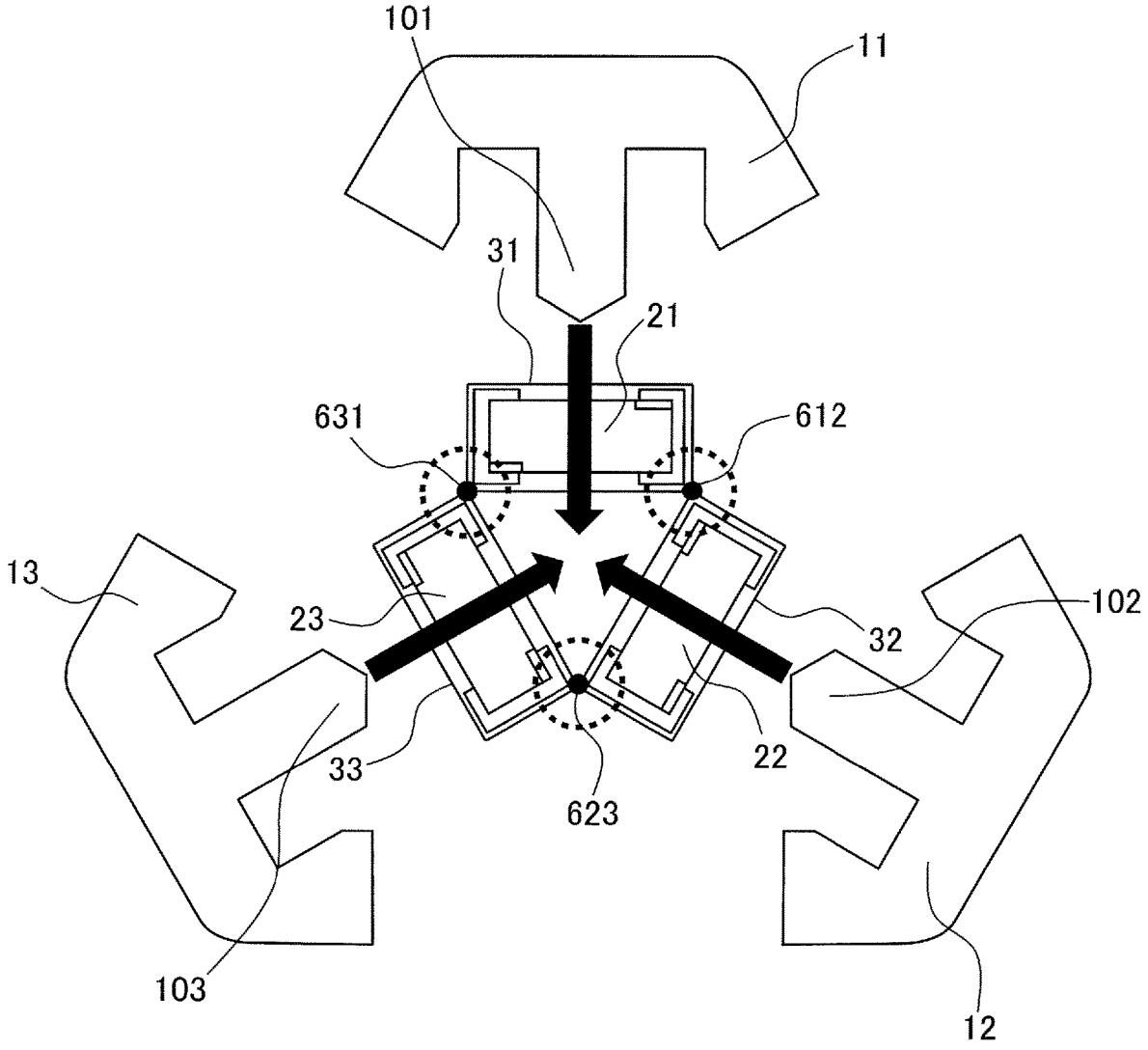
FIG. 7 is a plan view showing the step of attaching the peripheral iron core portions to the covering portions, in the manufacturing process of the reactor according to the embodiment.

FIG. 7 is a plan view showing the step of attaching the peripheral iron core portions to the covering portions, in the manufacturing process of the reactor according to the embodiment. After the covering portions (31, 32, and 33) are coupled together, as shown in FIG. 6, the peripheral iron core portions (11, 12, and 13) are attached to the covering portions (31, 32, and 33), respectively, as shown in FIG. 7. To be more specific, the iron core 101 of the peripheral iron core portion 11 is disposed in the opening of the covering portion 31. In the same manner, the iron core 102 of the peripheral iron core portion 12 is disposed in the opening of the covering portion 32. In the same manner, the iron core 103 of the peripheral iron core portion 13 is disposed in the opening of the covering portion 33.

By disposing the peripheral iron core portions (11, 12, and 13) in the openings of the covering portions (31, 32, and 33), the structure shown in FIG. 1 is obtained. In FIG. 1, the peripheral iron core portions 11 and 12 contact each other at the dividing surface 112. The peripheral iron core portions 12 and 13 contact each other at the dividing surface 123. The peripheral iron core portions 13 and 11 contact each other at the dividing surface 131. As a result, the peripheral iron core portions 11, 12, and 13 constitute the single peripheral iron core 1.

Figure 8:
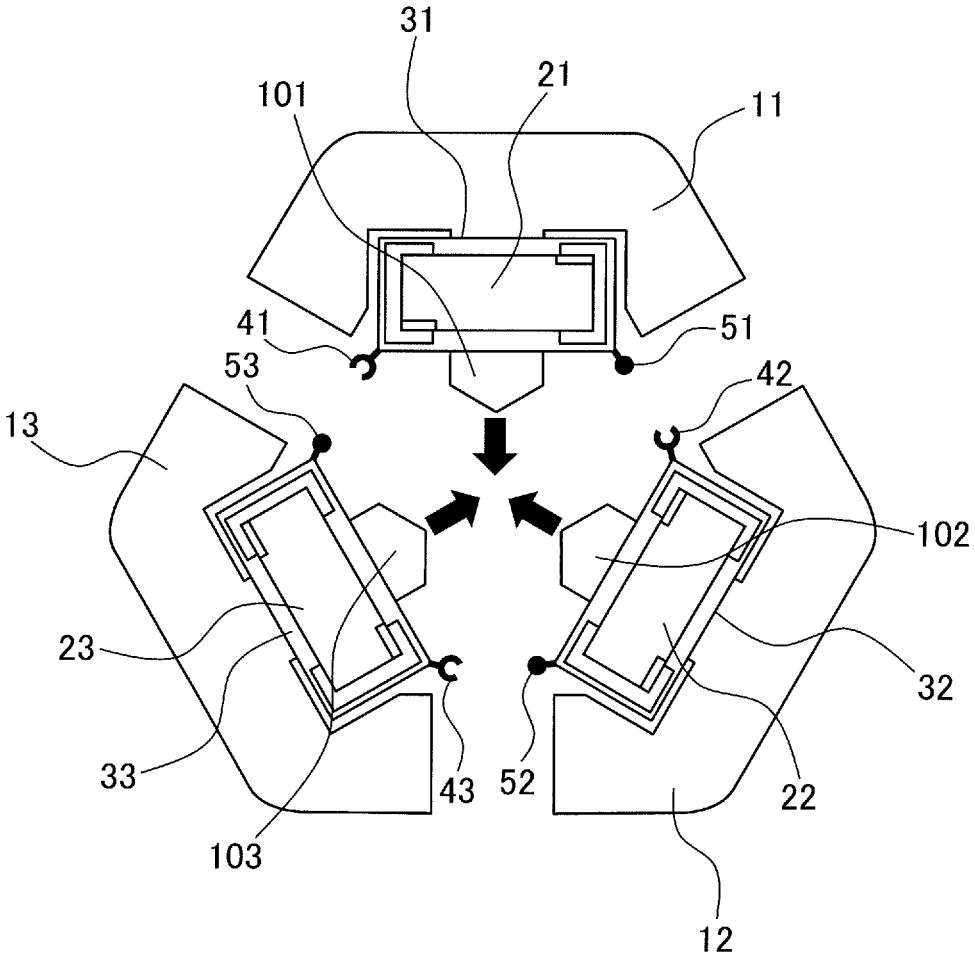
FIG. 8 is a plan view showing the step of assembling a plurality of peripheral iron core portions, in a manufacturing process of a reactor according to a modification example of the embodiment.

In the above embodiment, after the covering portions are coupled together, each of the peripheral iron core portions is attached to each the covering portions, but the present invention is not limited to this example. In other words, before the covering portions are coupled, each of the covering portions is paired with each peripheral iron core portion, and the covering portions are thereafter coupled to assemble the reactor. FIG. 8 is a plan view showing the step of assembling the peripheral iron core portions, in the manufacturing process of a reactor according to a modification example of the embodiment. First, the coils (21, 22, and 23) are covered with the covering portions (31, 32, and 33), respectively. Next, the covering portions (31, 32, and 33) are attached to the iron cores (101, 102, and 103) of the peripheral iron core portions (11, 12, and 13), respectively. Thereafter, the peripheral iron core portions (11, 12, and 13) are moved in the directions of the arrows of FIG. 8, the first fitting part 41 is fitted onto the second fitting part 53, the first fitting part 42 is fitted onto the second fitting part 51, and the first fitting part 43 is fitted onto the second fitting part 52. As a result, the structure of FIG. 1 is obtained.

As described above, in the reactor according to the embodiment, the peripheral iron core portions are assembled, after coupling the covering portions, thus enabling a reduction in manufacturing man-hour and ease of automation of the manufacturing process. Since the first fitting parts and the second fitting parts, which are provided in the covering portions, are fitted to each other, it is possible to obtain the secondary effect that the increased stiffness of the coils brings about a reduction in the influence of magnetic vibration and a reduction in noise.

According to the reactor of the embodiment of the present disclosure, since the casings for containing the coils are fitted to each other in the circumferential direction, it is possible to prevent an increase in manufacturing man-hour and an increase in difficulty in automation of the manufacturing process.

What is claimed is:

1. A reactor comprising a core body, wherein the core body includes a peripheral iron core composed of a plurality of peripheral iron core portions, at least three iron cores coupled to the peripheral iron core portions, and coils wound on the iron cores, gaps are formed between one of the iron cores and another iron core adjacent thereto, so as to be magnetically connectable through the gaps, and the reactor further includes a plurality of covering portions each arranged to enclose and cover each of the coils, and the covering portions adjacent in a circumferential direction can be fitted to each other.

2. The reactor according to claim 1, wherein fitting parts of the covering portions have a fitting structure.

3. The reactor according to claim 1, wherein fitting parts of the covering portions have an engaging structure.

4. The reactor according to claim 2, wherein the fitting parts are elastically deformable.

5. The reactor according to claim 1, wherein the covering portions are made of an insulating material.

6. The reactor according to claim 1, wherein the number of the iron cores is an integral multiple of three.

7. The reactor according to claim 1, wherein the number of the iron cores is an even number of four or more.

8. A reactor comprising a core body, wherein the core body includes a peripheral iron core composed of a plurality of peripheral iron core portions, at least three iron cores coupled to the peripheral iron core portions, and coils wound on the iron cores, gaps are formed between one of the iron cores and another iron core adjacent thereto, so as to be magnetically connectable through the gaps, and a plurality of covering portions is configured to cover each of the coils, wherein adjacent covering portions in a circumferential direction with respect to a center of the peripheral iron core are coupled together via first and second fitting parts located at corners of the covering portions, wherein the first fitting part of one covering portion receives the second fitting part of an adjacent covering portion.

9. A reactor comprising a core body, wherein the core body includes a peripheral iron core composed of a plurality of peripheral iron core portions, at least three iron cores coupled to the peripheral iron core portions, and coils wound on the iron cores, gaps are formed between each of adjacent iron cores of the at least three iron cores within the peripheral iron core, wherein the at least three iron cores are magnetically connectable through the gaps, and a plurality of covering portions is configured to cover each of the coils, wherein adjacent covering portions in a circumferential direction with respect to a center of the peripheral iron core are coupled together via first and second fitting parts located at corners of the covering portions, wherein the first fitting part of one covering portion receives the second fitting part of an adjacent covering portion.

* * * * *